United States Patent [19]

Harcúba et al.

[11] 3,939,747

[45] Feb. 24, 1976

[54] PROFILE PRESS AND PRECISION CUTTING APPARATUS WITH A PRESSURE MULTIPLIER

[75] Inventors: Siegfried Harcúba, Saarbrucken; Herbert Dits, Schmelz, both of Germany

[73] Assignee: Siegfried Harcuba, Saarbrucken, Germany

[22] Filed: Apr. 18, 1974

[21] Appl. No.: 461,994

[52] U.S. Cl. ..... 83/637; 83/556; 83/685

[51] Int. Cl.[2] ..... B26F 1/02

[58] Field of Search ..... 83/637, 685, 556, 561, 83/559, 560

[56] References Cited

UNITED STATES PATENTS

| | | | |
|---|---|---|---|
| 1,054,868 | 3/1913 | Preleuthner | 83/639 X |
| 3,301,112 | 1/1967 | Peterson | 83/637 X |

*Primary Examiner*—J. M. Meister

*Attorney, Agent, or Firm*—Marshall & Yeasting

[57] ABSTRACT

Profile press and precision cutting apparatus having a pressure multiplier comprising a cutting die loosely supported by a base plate, the cutting die being held in parallelism with the cutting tool by a guide means fixed to the piston rod, which means assures a torsion free guidance of said piston rod.

3 Claims, 5 Drawing Figures

PROFILE PRESS AND PRECISION CUTTING APPARATUS WITH A PRESSURE MULTIPLIER

The invention relates to a profile press and precision cutting apparatus having a pressure multiplicator converting air pressure into oil pressure, the plunger of which is hydraulically connected with at least one piston, a piston rod connected to said piston acting as a punch and having a cutting tool attached to it, a cutting die, and said apparatus also having a base plate.

The vertically movable cutting punch of the known punching machines and cutting presses is guided extremely precisely in direction to the cutting die which is fixed to the machine frame in axial alignment with the punch.

The cutting gap between the punch and the cutting die depends on the cutting material and the art of cutting. It amounts to approximately $\pm$ 150 $\mu$ with free cutting tools without guide means to approximately $\pm$ 80 $\mu$ with follow dies and to approximately $\pm$ 30 $\mu$ with precision cutting tools. To secure the proper gap in view of the acting forces and to eliminate deformations and misalignment of the axis, extremely rigid and therefore heavy-weight press bodies are required. In order to maintain the narrow tolerances, e.g. guide rods or columns are provided as well, guiding the punch which is movable relative to the cutting die fixed on the machine frame. Should the machine frame be made smaller or lighter than usual, in order to reduce its weight, elastic deformations of such a machine frame as well as the guide columns would be caused by even small lateral forces. The narrow tolerances of the cutting gap would be surpassed, which would inevitably lead to instant breakage of the cutting tool and other sequential damages.

Figure 1:
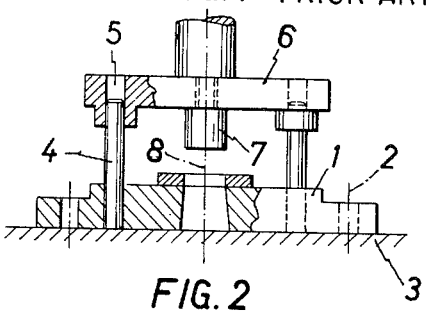
FIG. 1 PRIOR ART
FIG. 1 is a schematic view of a precision cutting apparatus of the prior art, shown partly in longitudinal section.

A cutting die 1 in FIG. 1 is fixed on an indicated machine frame 3 by means of clamping bolts at 2. The guide columns 4 are fixed on the cutting die 1, the guide columns 4 being axially guided in the bores 5 of a mounting support 6 of a punch 7 so as to guide the punch 7 in the direction of the axis 8 of the die opening.

The same arrangement is to be found also with other embodiments, in which the cutting die, which is also called a matrix, is firmly connected with the machine frame etc.

It is an object of the invention to do away with the above-mentioned shortcomings by providing a profile press and precision cutting apparatus by means of which a precision single cutting or an automatic follow cutting can be carried out with the highest precision by using a common guide means across a separated bearing surface, whereby such an apparatus may be made of light weight. With such an apparatus cutting tools serving also the purposes of profile making and other purposes should be applicable.

The invention does away with the technical and economical shortcomings in an easy way. According to the invention, in a profile press and precision cutting apparatus of the kind referred to, the cutting die is loosely supported by the base plate and is held in parallelism with the cutting tool by a guide means fixed to the piston rod which means assures a torsion free guidance of said piston rod.

Advantageously the guide means comprises a mounting support fixed to the piston rod, the ends of which are longitudinally shiftable in grooves in a cutting tool frame, and two opposite guide rods, each of which is connected at its one end with one end portion of the mounting support and is longitudinally guided at its other end in a bore of a guide plate lying adjacent to the cutting die, the guide rods entering openings in the base plate during the power stroke of the cutting tool, whereas the cutting die is spaced from the base plate, by which it is partly surrounded by a distance corresponding to the gap between the guide rod introduced in the bore of the base plate and the wall of said bore.

The technical novelty of the apparatus consists in the precise centering of the cutting die with regard to the punch or the cutting tool by means of guide elements, e.g. guide rods fixed to the body of the movable punch in such a way that the cutting die is loosely and shiftably supported by the base plate, which is opposite to the kind of fixation according to the prior art. In the event of an otherwise inadmissible elastic deformation of the cutting tool frame and resulting misalignment of the base plate, the displacements remain without influence on the precisely adjusted position of the cutting die.

Figure 2:
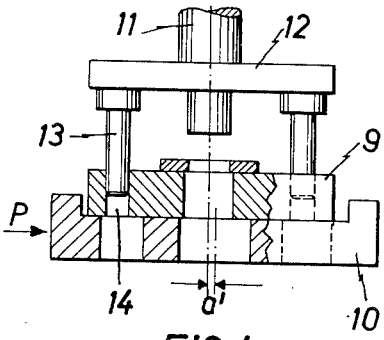
FIG. 2 is a schematic view of a precision cutting apparatus embodying the invention, some parts being shown in longitudinal section.

This is schematically shown in FIG. 2.

The cutting die 9 is loosely supported by the base plate 10 of a machine frame. By an uncontrolled force P normal to the axis 11 of the punch a displacement of the base plate 10 may be produced because of the desirably light and space saving structure of the frame, which displacement (marked *a'* in the figure) has however no influence on the precisely adjusted position of the cutting die 9 because the same is held axially in alignment with the punch by the mounting support 12 fixed on the punch and the guide elements 13 connected to said mounting support, which elements are aligned longitudinally in the bores 14 of the cutting die 9.

Figure 3:
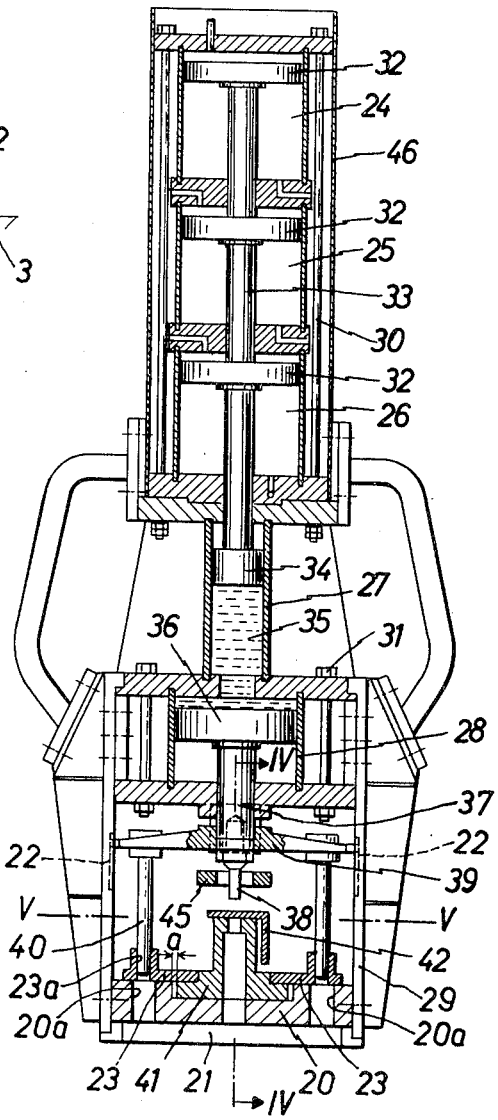
FIG. 3 is a schematic vertical section of a precision cutting apparatus embodying the invention.
Figure 5:
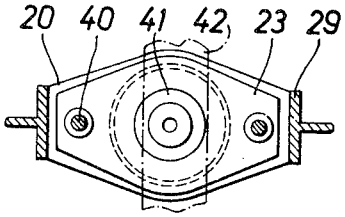
FIG. 5 is a section taken on the line V—V of FIG. 3.

The apparatus shown in FIG. 3 is a precision cutting device embodying the present invention which is actuated by a pressure multiplier having several pistons. Such a device gives the technique of precision tool cutting a new broad range of application, e.g. in the building industry. This embodiment displays clearly all the technical novelties and economic advantages of the invention. The shown embodiment is a handy and easily manoeuvrable hole cutting apparatus which can be used e.g. instead of a hand drilling machine and saves up to 80% of the working time.

The schematically drawn embodiment according to FIG. 3 comprises a pressure producing cylinder group 24,25,26,27, one pressure responding cylinder 28 and a cutting tool frame 21 which all are connected together in a constructural unit by means of tractor screws 30,31.

Three air operated pistons 32 work on a plunger 34 via a common piston rod. The so generated hydraulic pressure in oil 35 acts upon a working piston 36 to the piston rod 37 of which a cutting tool 38 and a mounting support 39 with the guide rods 40 are attached.

The guide rods 40 are attached to the opposite ends of the mounting support 39, and the ends of the mounting support are longitudinally movable in the grooves 22 of the cutting tool frame 29. Each guide rod 40 is guided in a bore 23*a* of a guide plate 23 which is loosely supported by a base plate 20 and is adjacent to the cutting die 41. During the power stroke of the cutting tool 38 the guide rods 40 enter in the bores 20*a* of the base plate 20; the diameter of these bores 20*a* is bigger than that of the guide rods 40.

The cutting die assembly which is loosely supported by the base plate 20 is radially spaced from the base plate 20 by a distance *a* which equals the gap between the guide rod 40 inserted in the bore 20*a* of the base plate 20 and the wall of the bore 20*a*. The base plate 20 is screwed to the cutting tool frame 29.

By a lateral shock against the cutting tool frame 29 the base plate 20 can be laterally displaced by the distance *a* with respect to the cutting die 41. This displacement has, however, no effect on the correct position of the cutting die 41 which is held always parallel with the cutting tool 38 because it is connected by the guide plate 23, both guide rods 40 and the mounting support 39 with the piston rod 37. Because of this connection no torsional moments will be produced which could lead to the torsion of the punch. These torsional moments occur only when the cutting edge of the cutting tool for cutting e.g. plastic material is not arranged in a plane, but forms a spatial curve. The internal longitudinal forces occuring during the cutting process are absorbed and compensated by the base plate 20.

Figure 4:
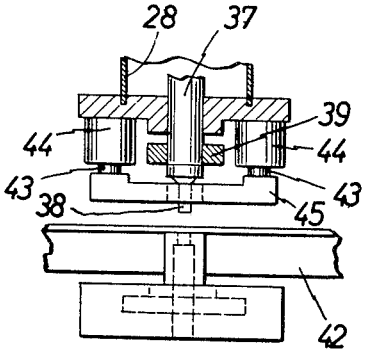
FIG. 4 is a section taken on the line IV—IV of FIG. 3 showing the mechanism for ejecting the finished piece.

In order to prevent the workpiece 42 (e.g. a steel angle) from being carried along with the returning punch after the completed cut action, a hydraulically or pneumatically controlled device for holding down is provided, as it can be seen in FIG. 4. The pistons 43 of two pneumatic or hydraulic cylinders 44 are connected with a bridge 45 which surrounds the cutting tool 38 and by means of which the workpiece 42 is held on the cutting die 41 during the cutting action and the following return movement of the cutting tool 38.

The necessary conduits and control members for compressed air or oil are not shown in FIG. 3, for the sake of clearness. These parts will be covered by a protecting sheath 46 at least within the limits of range of the pneumatic cylinders. The protecting sheath 46 can be designed as a cylindrical body covering all the parts whereby only the stock supply and removal as well as the pressure connections are kept free.

The profile press and precision cutting apparatus is operated preferably by compressed air which is usually available or which can be produced in movable compressor plants or which can be brought in compressed-air bottles to the assembly place. The requirements as to the volume of the compressed air are small.

The invention represents an essential technical novelty in the structure of machine tools and hand tools, because the prime costs and the working costs as well as the production costs of the tool are several times lower than those of voluminous precision presses. Accordingly, the range of application of such tools is broader and opens some new markets for the noncutting shaping carried out in a rational working process.

By the combination of the pneumatic-hydraulic pressure multiplier with the constructional feature of the loosely supported cutting die and in connection with the guide means guiding the cutting tool in parallelism with the punch axis and finally also with the so achieved torsionless guidance of the punch, all of which are of the highest importance, a light structure of presses can be achieved. By such a combination cutting and shaping qualities of a high precision and savings of weight ranging up to 90% of the weight of the known apparatus can be achieved.

What I claim is:

1. A profile press and precision cutting apparatus having a pressure multiplier for converting air pressure into oil pressure, said multiplier comprising an oil pressure-operated cylinder containing a piston having a piston rod to which is attached a cutting tool acting as a punch, wherein the improvement comprises a base plate, a cutting die assembly which rests on the base plate and is freely movable horizontally in all directions relative to the base plate, said base plate having a portion which at least partly surrounds the cutting die assembly, but is radially spaced therefrom in all directions, thereby accomodating free horizontal movement of the cutting die assembly in all directions relative to the base plate, and a plurality of guide rods which are rigidly connected to said piston rod and are parallel to the direction of travel of said piston rod, said guide rods extending into bores in the cutting die assembly and being long enough so that they extend into said bores throughout the entire stroke of said piston rod, to maintain the cutting die assembly in alignment with said piston rod during the cutting operation, irrespective of misalignment of the cutting die assembly with the base plate, thereby producing torsion-free guidance of the cutting tool and permitting the base plate to take up internally acting forces.

2. A profile press and precision cutting apparatus having a pressure multiplier for converting air pressure into oil pressure, said multiplier comprising an oil pressure-operated cylinder containing a piston having a piston rod to which is attached a cutting tool acting as a punch, wherein the improvement comprises a base plate, a cutting die assembly supported by the base plate, said base plate having a portion which at least partly surrounds the cutting die assembly but is radially spaced therefrom, and guide means which slidably connects said piston rod and said cutting die assembly and holds them in alignment during the cutting operation, irrespective of misalignment of the cutting die assembly with the base plate, thereby producing torsion-free guidance of the cutting tool and permitting the base plate to take up internally acting forces, said guide means comprising a mounting yoke fixed to the piston rod, a fixed frame having grooves in which the ends of the yoke are guided during the stroke of the piston rod, and a pair of guide rods, each having one end fixed to one end of the yoke, the cutting die assembly comprising a guide plate having two bores in which the other ends of said rods are longitudinally guided, and the base plate having openings into which said other ends of the rods enter during the power stroke of the piston rod.

3. Apparatus as claimed in claim 2, characterized in that the openings in the base plate receive the ends of the guide rods with a radial clearance as great as the radial clearance between the cutting die assembly and the surrounding portion of the base plate.

* * * * *